US010670199B2

(12) United States Patent
Vissenberg et al.

(10) Patent No.: US 10,670,199 B2
(45) Date of Patent: Jun. 2, 2020

(54) SPLIT BEAM LUMINAIRE AND LIGHTING SYSTEM

(71) Applicant: SIGNIFY HOLDING B.V., Eindhoven (NL)

(72) Inventors: Michel Cornelis Josephus Marie Vissenberg, Roermond (NL); Antonius Petrus Marinus Dingemans, Tilburg (NL); Willem Franke Pasveer, Dordrecht (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 14/352,699

(22) PCT Filed: Oct. 12, 2012

(86) PCT No.: PCT/IB2012/055552
§ 371 (c)(1),
(2) Date: Apr. 18, 2014

(87) PCT Pub. No.: WO2013/057644
PCT Pub. Date: Apr. 25, 2013

(65) Prior Publication Data

US 2014/0254153 A1 Sep. 11, 2014

Related U.S. Application Data

(60) Provisional application No. 61/548,247, filed on Oct. 18, 2011.

(51) Int. Cl.
*F21K 9/62* (2016.01)
*F21V 7/04* (2006.01)
(Continued)

(52) U.S. Cl.
CPC ..... *F21K 9/62* (2016.08); *F21V 7/0016* (2013.01); *F21V 7/043* (2013.01); *F21V 7/048* (2013.01);
(Continued)

(58) Field of Classification Search
CPC ..... F21K 9/54; F21V 13/02; F21V 23/0464; F21V 23/0471; F21V 7/0016
See application file for complete search history.

(56) References Cited

U.S. PATENT DOCUMENTS 6,582,103 B1 * 6/2003 Popovich ..... F21V 5/02 361/224
6,802,631 B1 * 10/2004 Hog et al. ..... 362/464
(Continued)

FOREIGN PATENT DOCUMENTS

JP 3599153133 A * 9/1984 ..... G01J 5/12
JP 10255513 A 9/1998
(Continued)

*Primary Examiner* — Sharon E Payne
(74) *Attorney, Agent, or Firm* — Daniel J. Piotrowski

(57) ABSTRACT

The invention relates to a luminaire and a lighting system. The luminaire includes first and second light sources adapted to emit light beams of two different beam patterns encompassed within a single chamber with specular outer walls that are parallel to the optical axis of the beam patterns of both types of light sources. Employing a chamber having specular outer walls aligned with the optical axis of the beam patterns of both types of light sources and adapted to specularly reflect at least a portion of light incident thereon allows more uniform appearance of the luminaire while preserving the respective total beam patterns of the beams produced by the first and second light sources as the light beams are incident on the exit window of the chamber.

18 Claims, 12 Drawing Sheets

(51) Int. Cl.

| | |
|---|---|
| ***F21V 7/00*** | (2006.01) |
| ***F21S 8/04*** | (2006.01) |
| ***F21S 8/02*** | (2006.01) |
| ***F21V 23/04*** | (2006.01) |
| ***F21V 13/02*** | (2006.01) |
| *F21Y 113/00* | (2016.01) |
| *F21Y 105/12* | (2016.01) |
| *F21Y 105/10* | (2016.01) |
| *F21Y 115/10* | (2016.01) |

(52) U.S. Cl.
CPC ..... *F21V 13/02* (2013.01); *F21V 23/0464* (2013.01); *F21V 23/0471* (2013.01); *F21Y 2105/10* (2016.08); *F21Y 2105/12* (2016.08); *F21Y 2113/00* (2013.01); *F21Y 2115/10* (2016.08)

(56) References Cited

U.S. PATENT DOCUMENTS

| | | | | |
|---|---|---|---|---|
| 7,942,556 | B2 * | 5/2011 | Harbers et al. | 362/294 |
| 2008/0084693 | A1 | 4/2008 | Shimada | |
| 2008/0310158 | A1 | 12/2008 | Harbers et al. | |
| 2009/0167206 | A1 * | 7/2009 | Ackermann et al. | 315/294 |
| 2010/0053958 | A1 * | 3/2010 | McDermott et al. | 362/235 |
| 2010/0264830 | A1 * | 10/2010 | Van Endert | G06F 3/017 315/149 |
| 2012/0026726 | A1 * | 2/2012 | Recker | F21K 9/13 362/157 |
| 2013/0241435 | A1 * | 9/2013 | Lamvik | F21S 8/02 315/291 |

FOREIGN PATENT DOCUMENTS

| | | | | |
|---|---|---|---|---|
| JP | 2007287384 | A | 11/2007 | |
| JP | 2008505436 | A | 2/2008 | |
| WO | WO 2005/121641 | A1 * | 12/2005 | F21V 14/00 |
| WO | 2008029352 | A1 | 3/2008 | |
| WO | 2011039690 | A1 | 4/2011 | |

* cited by examiner

SPLIT BEAM LUMINAIRE AND LIGHTING SYSTEM

CROSS-REFERENCE TO PRIOR APPLICATIONS

This application is the U.S. National Phase application under 35 U.S.C. § 371 of International Application No. PCT/IB2012/055552, filed on Oct. 12, 2012, which claims the benefit of U.S. Provisional Patent Application No. 61/548,247, filed on Oct. 18, 2011. These applications are hereby incorporated by reference herein.

FIELD OF THE INVENTION

Embodiments of the present invention relate generally to the field of illumination systems, and, more specifically, to a luminaire and a lighting system for providing illumination of a space, such as an office, in accordance with a predetermined illumination level.

BACKGROUND OF THE INVENTION

As the efficacy (measured in lumen per Watt) and the luminous flux (measured in lumen) of light emitting diodes (LEDs) continues to increase and prices continue to go down, LED illumination and LED-based luminaires are becoming viable alternatives to and at a competitive level with until now predominant common light bulbs or tube luminescent based lamps for providing large-area illumination.

By using LEDs it is possible to decrease the energy consumption, a requirement which is well in line with the current environmental trend. As a further consequence of having the possibilities to provide bright light even when using compact LEDs, a number of different lighting system have been proposed greatly differing from the standard lighting system comprising a common light bulb. In line with this and by means of using LEDs instead of light bulbs, a user is also given a more flexible control of the lighting system illumination functionalities, for example in relation to intensity dimming control of beam direction.

An example of such a lighting system is disclosed in WO 2011039690, describing a modular luminaire 100 comprising two light-emitting portions 102 and 104, as shown in FIG. 1. The two portions are individually controllable and are configured to provide complementary beam patterns. The portion 102 is configured to emit a relatively narrow beam of light illuminating a narrow, task, area. The portion 104 is configured to emit a relatively wide, batwing-type beam of light providing ambient illumination of a background area surrounding the task area. Such a split beam luminaire enables a local dimming lighting solution with higher energy savings, lower cost, and a higher comfort level than conventional office luminaires.

With a split beam luminaire, preserving the beam patterns is important. The luminaire 100 achieves preservation of the beam patterns by having the multiple light sources and their corresponding optics 106 configured to allow generation of the narrow beam pattern arranged in a separate lighting chamber, apart from the multiple light sources and their corresponding optics 108 configure to allow generation of the batwing-type pattern. This, however, provides limitations with regard to the appearance of the luminaire as such a separation of the narrow-beam and the wide-beam sources results in different appearance of the luminaire if viewed from different angles.

What is needed in the art is a split beam luminaire capable of providing more uniform luminance of the luminaire's light-emitting surface while preserving the beam patterns of the narrow and wide beams.

SUMMARY OF THE INVENTION

According to one aspect of the present invention, the above challenge is at least partly met by a luminaire including one or more first light sources and one or more second light sources encompassed by a single chamber. Each of the first light sources is configured to emit a first light beam having a first beam pattern, while each of the second light sources is configured to emit a second light beam having a second beam pattern, different from the first beam pattern. The chamber encompassing the first light sources and the second light sources includes one or more outer side walls and an exit window. The outer side walls of the chamber are substantially specular and are substantially parallel to the optical axis of each first light beam and the optical axis of each second light beam. At least a part of the outer side walls is adapted to specularly reflect at least a portion of light incident thereon to be incident onto the exit window.

Embodiments of the present invention are, in part, based on the recognition that it is desirable to place the light sources of a split beam luminaire (i.e., the light sources emitting light beams with two different beam patterns) in a single chamber, the chamber being used e.g. to support a diffusive cover, because such an arrangement would allow for a more uniform appearance of the luminaire from different viewing angles. Embodiments of the present invention are further based on the recognition that if the light sources of a split beam luminaire are to be encompassed by a single chamber, care should be taken with respect to the chamber so that the beam patterns of both types could be substantially preserved. For example, it would not be appropriate to place these light sources of a split beam luminaire in a chamber conventionally used for multiple light sources emitting light beams with the same beam shape or without a particular beam shape. The walls of such a conventionally used chamber are typically made of a diffusive material and typically form a sharp angle (i.e. smaller than 90°) with the exit window of the chamber. As a result, the beam pattern cannot be preserved within such a conventional chamber.

A luminaire according to embodiments of the present invention includes first and second light sources adapted to emit light beams of two different beam patterns encompassed within a single chamber with substantially specular outer walls that are substantially parallel to the optical axis of the beam patterns of both types of light sources. Employing a chamber having substantially specular outer walls which are substantially aligned with the optical axis of the beam patterns of both types of light sources and adapted to specularly reflect at least a portion of light incident thereon allows more uniform appearance of the luminaire while preserving the respective total beam patterns of the beams produced by the first and second light sources as the light beams are incident on the exit window of the chamber.

As used herein the term "beam pattern" of a light source refers to the intensity distribution of the light source which gives the flux per solid angle in all direction of space.

Further, the term "substantially" in the context of substantially specular walls of the chamber (both the outer side walls and the inner side walls) is used to indicate that the walls don't necessarily have to be 100% specular. According to various embodiments of the present invention, semi-specular reflective walls that cause a limited beam broadening of the specular reflected beam of less than 10 degrees FWHM may also be employed. Furthermore, not all the light needs to be specularly or semi-specularly reflected, which means that part of the light beams incident thereon is (semi-)specularly reflected while the remainder of the light beams may be (semi-)specularly transmitted, diffusively transmitted or may be lost (e.g. absorbed). Fully diffuse scattering (e.g. Lambertian scattering which causes strong beam broadening) should be avoided or at least limited to less than 5% of the reflected light.

Similarly, the term "substantially" in the context of the walls of the chamber (both outer side walls and inner side walls) being substantially aligned with an optical axis of each of the emitted light beams or substantially parallel to the axis is used to indicate that the walls don't necessarily have to be 100% aligned. A deviation of 5-10 degrees from being perfectly aligned would also be acceptable and within the scope of the present invention.

While in the discussions presented herein, the terms "substantially" are not always used in these two contexts in order to not obscure the technical description, it is to be understood that these terms do apply to these contexts in all of the embodiments of the present invention.

Each of the first light sources may be configured to emit a light beam with relatively narrow beam pattern (so-called "task beam"), adapted to illuminate a predefined area, e.g. 2×25-2×35 degrees full width half maximum (FWHM). This way, the task beam may cover the area that is associated with a single luminaire in a typical office layout. The beam pattern of the task beam is preferably confined within approximately 2×50 degrees cut-off angle in order to avoid that the task beam is illuminating the area below a neighboring luminaire.

Each of the second light sources may be configured to emit a light beam with a relatively wide beam pattern (so-called "ambient beam"), adapted to illuminate a background area surrounding the predefined area illuminated with the task beam. The beam pattern of the ambient beam is preferably hollow shaped, e.g. a beam pattern with a low intensity at 0 degrees and a peak intensity between 30 and 45 degrees, where, as used herein, the term "hollow shaped light beam" refers to a beam of light with a relative dark area at the center of the beam. The beam pattern of the ambient beam is preferably used to illuminate a region in between approximately 2×20 degrees (in order to have a smooth overlap with the task beam) and 2×60 degrees (about 65 degrees is the typical cut-off angle for European office luminaires, to avoid indirect glare). In other regions of the world, the norms on glare are often less strict. For these regions, the peak intensity and the beam cut-off may be shifted to larger angles.

In an embodiment, to obtain different beam patterns from the first and second light sources, each light source may include a light emitter, such as e.g. one or more light emitting elements such as LEDs, and an associated beam shaping optics. Possible materials that could be used for the LEDs include inorganic semiconductors, such as e.g. GaN, InGaN, GaP, AlInGaP, GaAs, AlGaAs, or organic semiconductors, such as e.g. small-molecule semiconductors based on Alq3 or polymer semiconductors based e.g. on the derivatives of poly(p-phenylene vinylene) and polyfluorene. The associated beam shaping optics could include an appropriately designed lens, TIR (total internal reflection) collimator, or metallic reflector. The beam shaping optics may be configured to generate a beam of a specific width/pattern. For example, for the first light sources configured to generate task beams, the beam shaping optics may be designed to generate a beam corresponding to the size of an office desk or corresponding to the area defined by the typical luminaire spacing in two directions (the latter is particularly advantageous for implementations where it is not known where the desks would be with respect to the luminaires). For the second light sources configured to generate ambient beams, the beam shaping optics may be designed to generate a beam with a relatively low intensity part corresponding to the shape of the task beams and adapted to illuminate the surrounding background area. In this manner, the first and second light sources may be adapted to e.g. provide complementary beam patterns to obtain a smooth total beam pattern for the luminaire.

Further, the emission of the first light sources is preferably controlled independently from emission of the one or more second light sources, in order to allow for different illumination levels at the task area and at the background area surrounding the task area. As described above, the hollow shaped beam pattern provided by the second light source may be generated using at least one light emitting element and associated beam shaping optics designed to create a hollow beam shape. Alternatively, the second beam of light may be generated using a first and a second light emitting elements of the second light source, the first and second light emitting elements of the second light source being separately controllable with respect to the light emitting element(s) of the first light source, each of the first and second light emitting elements of the second light source configured to generate complementary beam patterns together configured to create the hollow shaped beam pattern.

In an embodiment, the exit window may be configured to provide controlled beam broadening of at least a portion of the first and second light beams incident thereon. To that end, the exit window may include a holographic diffuser with Gaussian scattering profile with the full width half maximum value between 10 and 20 degrees or a lens array with an f# between 2 and 5, or any other curved or faceted surface that produces a similar beam broadening. Using an exit window that can provide controlled beam broadening as opposed to a strong diffuser exit window typically used in conventional light mixing chambers allows fulfilling office regulations on glare by somewhat diffusing the light beams incident on the exit window within the chamber while at the same time only slightly broadening and, thereby, substantially preserving the beam shapes.

In various embodiments, the outer side walls of the chamber may be faceted, curved, or both faceted and curved, and may be at a distance of a half pitch from the nearest light source. The chamber may further include one or more inner side walls which are also specular, parallel to the optical axis of the each first light beam and the optical axis of the each second light beam, and adapted to reflect at least a portion of light incident thereon to be incident onto the exit window.

In a preferred embodiment, the chamber is rotationally symmetric with respect to one or more angles of rotation around an axis of symmetry of the chamber and the first and/or second light sources are arranged within the chamber symmetrically with respect to the axis of symmetry of the chamber, in order to further preserve the total beam patterns within the chamber.

Besides preserving the beam shape, it may also be desirable to create an appealing luminance pattern when looking at the luminaire. Therefore, the first and second light sources are preferably arranged within the chamber so that they are evenly distributed and alternating, e.g. arranged in multiple clusters of a 3×8 or 4×9 checkerboard pattern, so that the light of the two beams appears to be emitted from a single area source.

Preferably, the numbers of the first and second light sources are balanced because strongly unbalanced distribution of light sources causes a large difference in drive currents and, therefore, a relatively high peak brightness for the light sources in a string with less light emitting elements. For example, a ratio between the number of the first light sources and the number of the second light sources could be between 3/7 and 7/3, preferably between 4/6 and 6/4, and most preferably equal to 1.

In an embodiment, the luminaire may further include one or more sensors for presence detection and/or a sensor for local light measurement. The sensors for presence detection could include two sensors, the first sensor having a detection cone substantially overlapping with the first light beam while the second sensors being a broad-angle sensor.

According to another aspect of the present invention, a lighting system for an office space is provided. The lighting system includes a plurality of luminaires as described herein and a control unit adapted to acquire a task and background area lighting level configuration for the office space, and to control the first and second light sources of each luminaire such that a total illumination pattern produced by the plurality of luminaires corresponds to the task and background area lighting level configuration for the office space.

Hereinafter, an embodiment of the invention will be described in further detail. It should be appreciated, however, that this embodiment may not be construed as limiting the scope of protection for the present invention.

BRIEF DESCRIPTION OF THE DRAWINGS

In all figures, the dimensions as sketched are for illustration only and do not reflect the true dimensions or ratios. All figures are schematic and not to scale. In particular the thicknesses are exaggerated in relation to the other dimensions. In addition, details such as LED chip, wires, substrate, housing, etc. have sometimes been omitted from the drawings for clarity.

DETAILED DESCRIPTION OF THE EMBODIMENTS

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1:
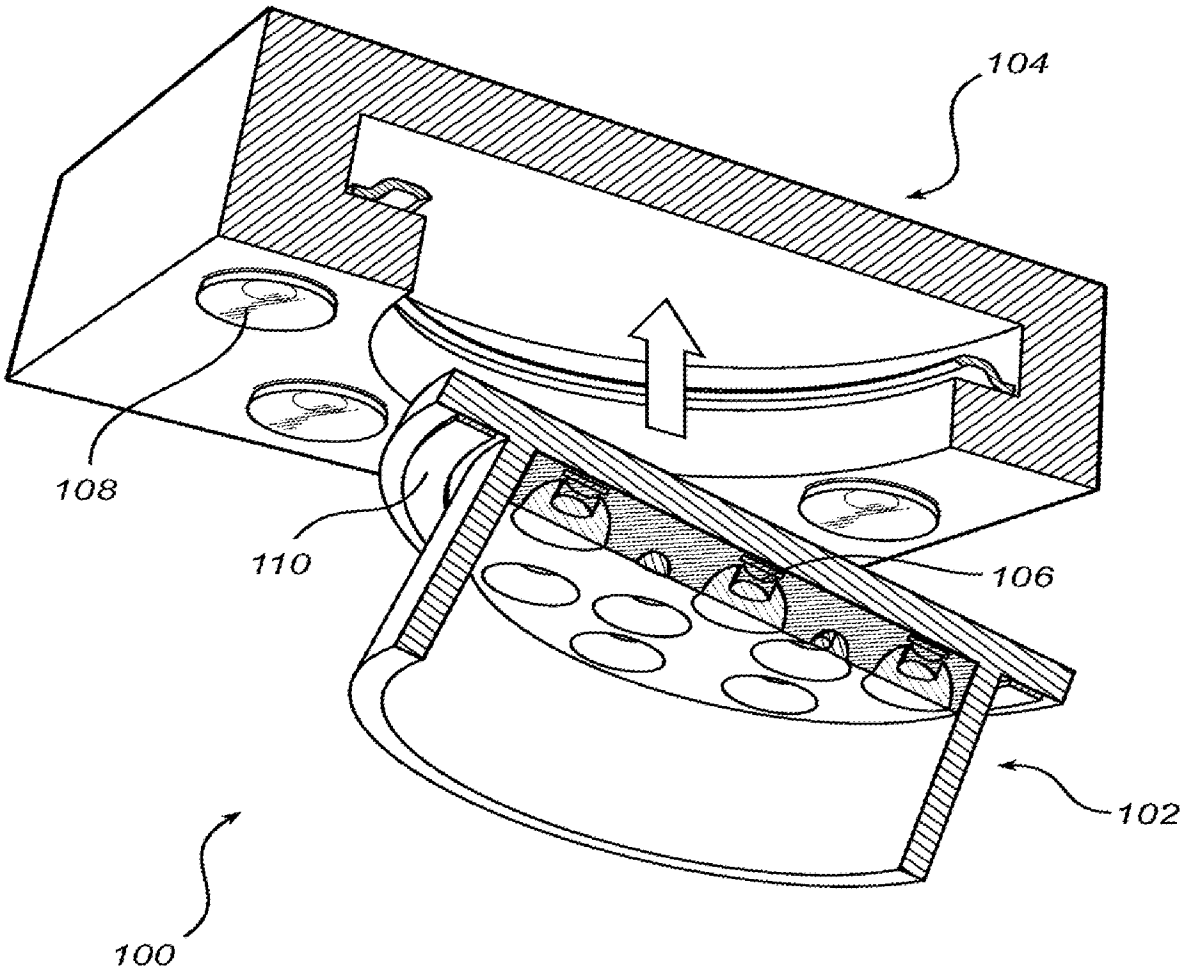
FIG. 1 (PRIOR ART)
FIG. 1 illustrates a modular split beam luminaire according to prior art.
Figure 2:
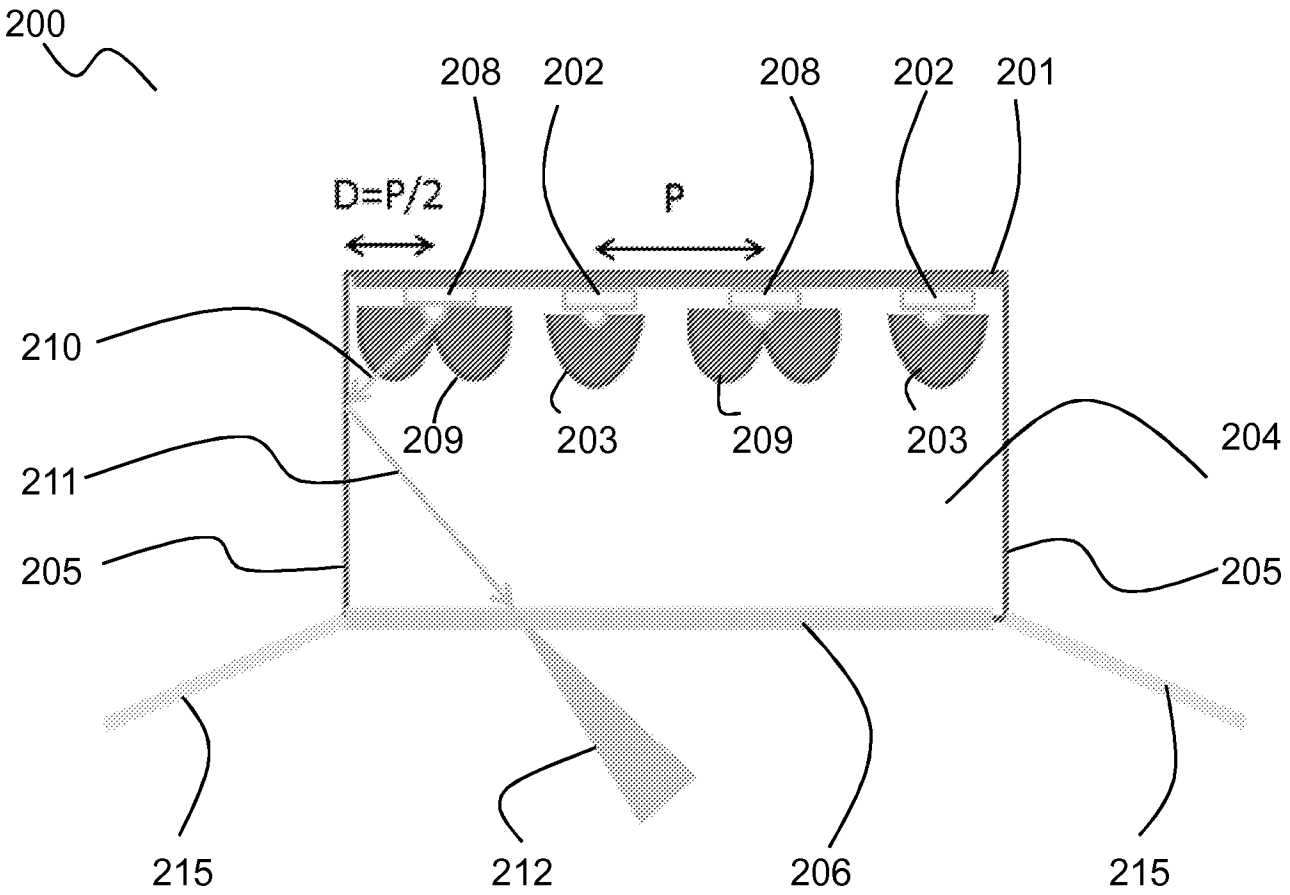
FIGS. 2, 3, & 4 illustrate split beam luminaires according to various embodiments of the present invention.

FIG. 2 illustrates a split beam luminaire 200 according to one embodiment of the present invention. As shown, the luminaire 200 includes first light sources 202 and second light sources 208, the light sources 202 and 208 configured to emit light beams with different beam patterns. To that end, each of the light sources 202 and 208 may include one or more light emitting elements such as e.g. one or more LEDs and associated beam shaping optics enabling the light sources 202 and 208 to provide light beams with different predetermined beam patterns. In an exemplary embodiment shown in FIG. 2, the light sources 202 are shown to provide task beams with a relatively narrow beam pattern 203 while the light sources 208 are shown to provide ambient beams with an in comparison broader, preferably hollow, beam pattern 209. As discussed above, the beam pattern 203 could be a narrow pattern with e.g. 2×25 degrees FWHM, while the beam pattern 209 could be a pattern with a hollow center and peak intensity between 30 and 40 degrees. In one embodiment, the corresponding beam shaping optics for the light sources 202 and 208 may include appropriately designed lenses that could be manufactures by e.g. injection molding in the form of a plate containing an array of such lenses. In alternative embodiments, the beam-shaping optics could include TIR collimators or metallic reflectors.

As also shown in FIG. 2, the light sources 202 and 208 are disposed on a substrate 201 and are encompassed by a chamber 204 comprising outer side walls 205 and an exit window 206. For dissipating heat generated by the first and second light sources, the luminaire 200 may further include a heat sink (not shown in FIG. 2).

The substrate 201 may comprise a printed circuit board (PCB) with light sources 202 and 208 being more or less evenly distributed and alternating over the PCB, e.g. with a pitch (P) of 20 to 30 mm, i.e. around 25 mm. In one embodiment, the substrate 201 may be configured so that the light sources 202 are (electrically) connected in one string while the light sources 208 are (electrically) connected in another string, the two strings being individually and separately controllable. In this manner, the light sources 202 may be dimmed independently of the light sources 208 to achieve the desired illumination level at the task and background areas. In other embodiments, each one of the light sources 202 and 208 may be controlled independently of the other light sources or sub-groups of the light sources 202 and/or 208 may be connected to different strings for the individual control of each sub-group.

The chamber 204 may be configured to encompass the light sources 202 and 208 in such a manner that the outer side walls 205 of the chamber are located at a distance of approximately half a pitch from the nearest light source (P/2), ensuring that the luminaire 200 appears to be uniformly lit, including the edges of the luminaire. If the outer side walls 205 were significantly further away from the nearest light source, the light would appear to come from a deeper layer than the exit window 206. In addition, a relatively large exit window would be needed, thus increasing the cost of the luminaire.

However, when the outer side walls 205 are so close to the light sources as shown in FIG. 2, they may happen to be in the optical path of the light emitted by the light sources and, consequently, additional measures should be taken as to not destroy the beam shape. According to various embodiments of the present invention, such measures include making the outer side walls 205 of the chamber 200 specularly reflecting and substantially parallel (±5 or ±10 degrees) to the optical axis of the beam patterns of the light beams generated by the light sources 202 and 208. The outer side walls 205 being specularly reflecting means that, each light beam emitted by either the first or second light source that is incident onto the outer side walls 205 at a particular incoming angle, is reflected by the outer side walls 205 at a single outgoing angle. This is schematically shown in FIG. 2, where a beam portion 210 (which is a portion of the hollow beam generated by the second light source 208) is incident on the outer side wall 205 shown on the left of the chamber 204, is specularly reflected from the outer side wall 205, as shown with a beam portion 211.

Employing a chamber with outer side walls 205 that are parallel to the optical axis of the emitted light beams and are specular allows maintaining the total beam pattern for each of the two different beam patterns of the light sources 202 and 208. In addition, the configuration of FIG. 2 allows the brightness area to remain fixed to the luminaire center and allows using a smaller exit window (as compared with an embodiment of the outer side walls being further away from the nearest light source). Further, by properly choosing the edge distance of approximately half a pitch to the nearest light source, it can be avoided that a dark or bright luminance appears at the edge of the luminaire 200 (i.e., an inhomogeneous exit window can be avoided).

In various embodiments, the outer side walls 205 of the chamber 204 may be planar, multi-faceted, curved, or both multi-faceted and curved, as long as the normal to the reflecting surface is perpendicular to the optical axis of the luminaire (up to a few degrees deviation, as described above). Using facets or curved surfaces increases the number of source images and, therefore, can improve the light mixing properties of the chamber 204. By having vertically oriented outer side walls 205, i.e. oriented along the optical axis of the light beams, the reflected light remains oriented along the beam direction.

The chamber 204 may further include one or more inner side walls (not shown in FIGS. 2-4, but illustrated in FIG. 10) which, similar to the outer side walls 205, are also substantially specular, substantially parallel to the optical axis of the light beams, and adapted to reflect at least a portion of light incident thereon to be incident onto the exit window 206. Similar to the outer side walls 205, the inner side walls of the chamber may be planar, multi-faceted, curved, or both multi-faceted and curved, as long as the normal to the reflecting surface is perpendicular to the optical axis of the luminaire (up to a few degrees deviation, as described above for the outer side walls 205).

The exit window 206 should also be designed so that it would not destroy the beam shapes as the light exits the chamber 204. In an embodiment, the exit window 206 may be used to provide controlled scattering of light and controlled beam broadening so that the brightness of the emitted light may be reduced while the beam shape is only slightly broadened. To that end, the exit window 206 may be a light diffuser, such as e.g. a 10-20 degrees FWHM holographic diffuser with a Gaussian scattering distribution profile or a lens array with an f# between 2 and 5. Continuing with the beam portion 210 described above, FIG. 2 further illustrates that the beam that is specularly reflected by the outer side wall 205 and is incident on the exit window 206 (i.e., the beam shown with the beam portion 211) is slightly broadened by the exit window 206 upon exiting of the chamber 204, as shown with a beam portion 212. Combination of such an exit window with the light sources and the outer side walls as described above allows obtaining a luminaire that can fulfill office regulations with respect to glare while, at the same time, may be versatile enough to allow for different beam shapes.

In an embodiment, an optional slightly sloped white rim or baffle may be used, as shown in FIG. 2 with a baffle 215 extending from the exit window 206. Depending on the intended light effect (e.g. indirect lighting via the baffle 215 or not), the steepness of the baffle 215 may be tuned, where the shallow baffle would be the least illuminated.

Furthermore, in an optional embodiment, the luminaire 200 may further include one or more sensors for presence detection and/or a sensor for local light measurement (these sensors are not shown in FIG. 2). The sensors for presence detection could include two sensors, the first sensor having a detection cone substantially overlapping with the task beam while the second sensor being a broad-angle sensor.

Figure 3:
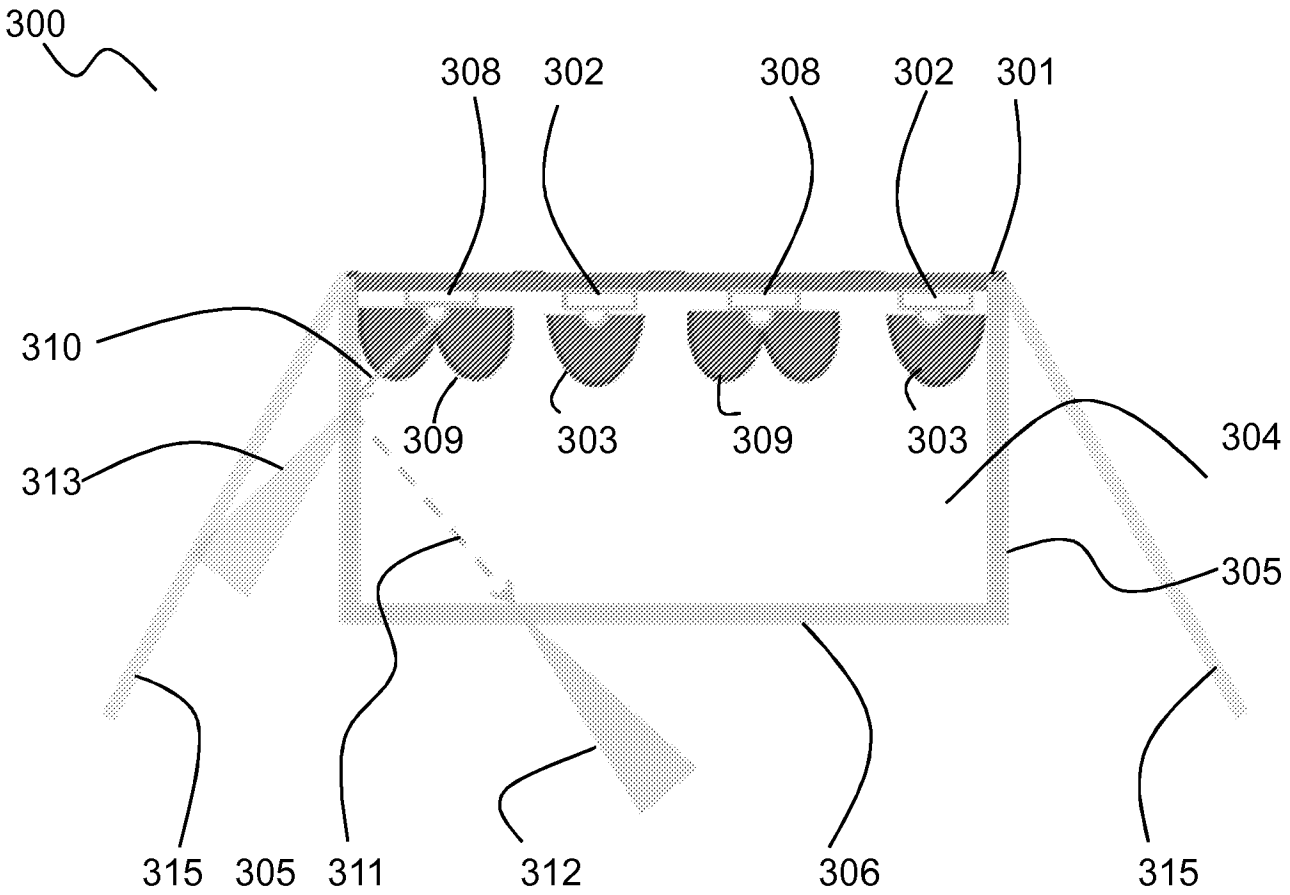

FIG. 3 illustrates a split beam luminaire 300 according to another embodiment of the present invention. The luminaire 300 is similar to the luminaire 200, described above, in that it includes first and second light sources 302 and 308, disposed on a substrate 301 and adapted to generate light beams with beam pattern 303 and 309, respectively. Since elements 301, 302, 303, 308, and 309 shown in FIG. 3 are analogous to the elements 201, 202, 203, 208, and 209, respectively, described above with respect to FIG. 2 and which descriptions are also applicable to FIG. 3, in the interests of brevity, the descriptions of these elements are not repeated here. Further, similar to the chamber 204, the light sources 302 and 308 are encompassed by a chamber 304, the chamber 304 comprising one or more outer side walls 305 and an exit window 306. The chamber 304 is similar to the chamber 204 described above, but there are also some differences.

The outer side walls 305 of the chamber 304 are partially specularly reflecting and partially transmitting so that, one portion of the light beams emitted by either the first or second light source that is incident onto the outer side walls 305 at a particular incoming angle, may be reflected by the outer side walls 305 at a single outgoing angle, while another portion may be transmitted through the outer side walls 305, possibly with a slight, controlled, beam broadening. This is schematically shown in FIG. 3, where a beam portion 310 (which is a portion of the hollow beam generated by the second light source 308) is incident on the outer side wall 305 shown on the left of the chamber 304, is partially specularly reflected from the outer side wall 305, as shown with a beam portion 311, and partially transmitted through the outer side wall 305, as shown with a beam portion 313. Similar to the beam portion 211 illustrated in FIG. 2, the beam portion 311 reflected from the outer side wall 305 is then slightly broadened by the exit window 306, as shown with a beam portion 312.

Similar to the chamber 204 described above, employing a chamber with outer side walls 305 that are parallel to the optical axis of the emitted light beams and are partially specularly reflecting allows maintaining the total beam pattern for each of the two different beam patterns of the light sources 302 and 308. The embodiment of FIG. 3 is especially suited for luminaires with a strong indirect lighting component on the baffle 315 and/or luminaires with a reduced build-in depth.

Persons skilled in the art will easily recognize which other discussions provided above with respect to the luminaire 200 (e.g. the discussions with respect to the distance from the nearest light source and the various shapes of the outer side walls, the discussions with respect to the inner side walls of the chamber, baffle, heat sink, or sensors for presence detection and local light measurement) are also applicable to the luminaire 300. Therefore, in the interests of brevity, those discussions are not repeated here.

Figure 4:
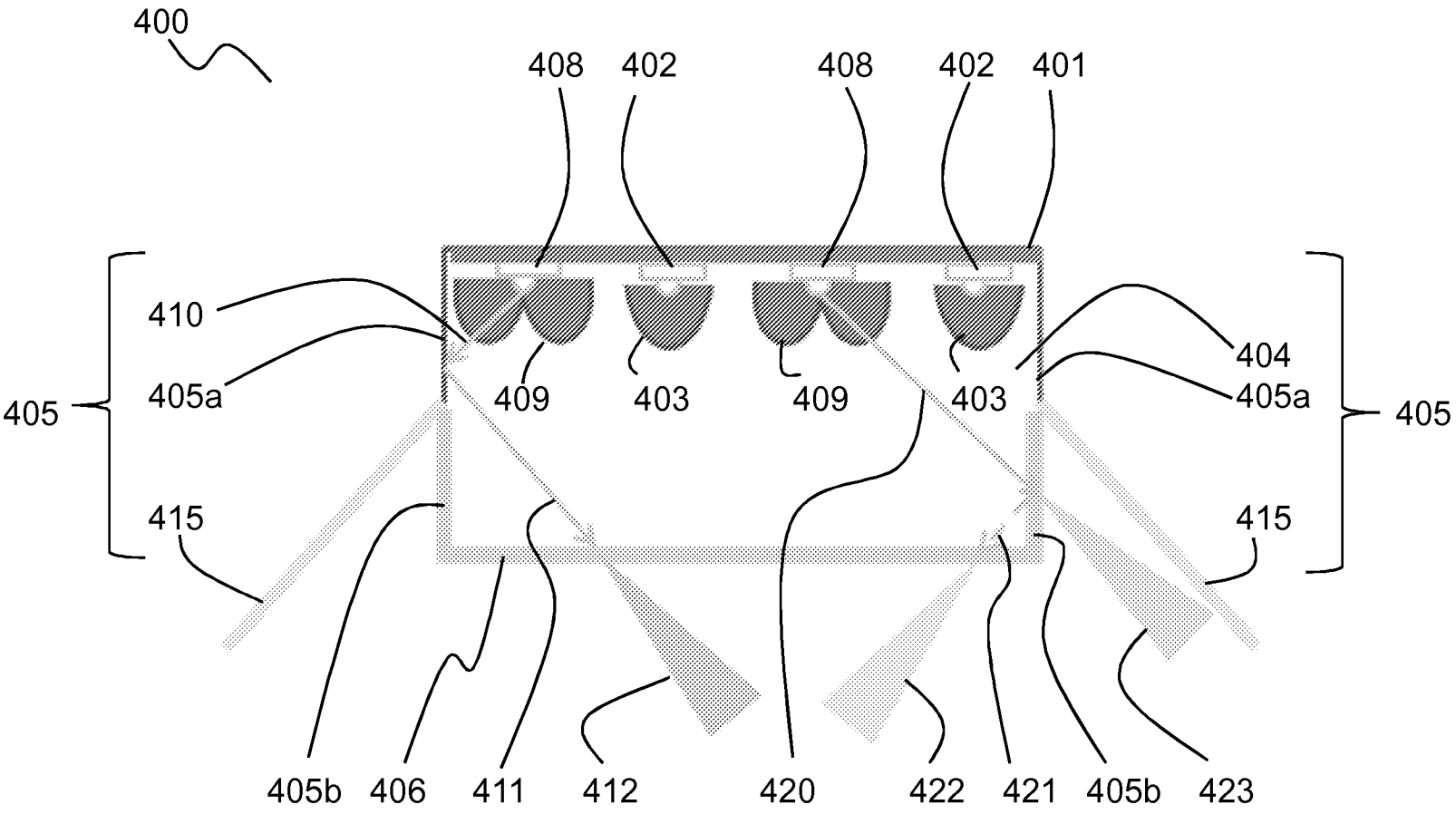

FIG. 4 illustrates a split beam luminaire 400 according to yet another embodiment of the present invention. Like the luminaire 300, the luminaire 400 is also similar to the luminaire 200 in that it includes first and second light sources 402 and 408, disposed on a substrate 401 and adapted to generate light beams with beam pattern 403 and 409, respectively. Since elements 401, 402, 403, 408, and 409 shown in FIG. 4 are analogous to the elements 201, 202, 203, 208, and 209, respectively, described above with respect to FIG. 2 and which descriptions are also applicable to FIG. 4, in the interests of brevity, the descriptions of these elements are not repeated here. Further, similar to the chambers 204 and 304, the light sources 402 and 408 are encompassed by a chamber 404, the chamber 404 comprising one or more outer side walls 405 and an exit window 406.

The chamber 404 is similar to the chambers 204 and 304 described above, but there are also some differences. In fact, the chamber 404 may be considered to be a combination of the chamber 204 and the chamber 304 described above in that the outer side walls 405 include sections 405*a* which are specularly reflecting and sections 405*b* which are partially specularly transmitting. The sections 405*a* of the chamber 404 are similar to the outer side walls 205 of the chamber 204 in that each of the light beams emitted by either the first or second light source that is incident onto the sections 405*a* at a particular incoming angle, is reflected by the sections 405*a* at a single outgoing angle. This situation is schematically shown in FIG. 4, where a beam portion 410 (which is a portion of the hollow beam generated by one of the second light sources 408) is incident on the section 405*a* of the outer side wall 405 shown on the left of the chamber 404, is specularly reflected from the section 405*a*, as shown with a beam portion 411, and then is slightly broadened by the exit window 406, as shown with a beam portion 412.

The sections 405*b* of the chamber 404 are similar to the outer side walls 305 of the chamber 304 in that one portion of the light beams emitted by either the first or second light source that is incident onto the sections 405*b* at a particular incoming angle, is reflected by the sections 405*b* at a single outgoing angle (i.e. specularly reflected), while another portion is transmitted through the sections 405*b*. This situation is schematically shown in FIG. 4, where a beam portion 420 (which is a portion of the hollow beam generated by another one of the second light sources 408) is incident on the section 405*b* of the outer side wall 405 shown on the right of the chamber 404, is partially specularly reflected from the section 405*b* onto the exit window 406, as shown with a beam portion 421, and partially specularly transmitted through the section 405*b*, as shown with a beam portion 423.

Similar to the beam portions 211 and 311, the beam portions 411 and 421 incident on the exit window 406 are slightly broadened by the exit window, as shown with beam portions 412 and 422, respectively.

The embodiment of FIG. 4 includes the advantages of the embodiments described for the luminaires 200 and 300 above. An additional advantage of the embodiment of FIG. 4 is the smaller build-in depth of the luminaire 400, as compared to the luminaire 200 of FIG. 2.

Persons skilled in the art will easily recognize which other discussions provided above with respect to the luminaires 200 and 300 (e.g. the discussions with respect to the distance from the nearest light source and the various shapes of the outer side walls, the discussions with respect to the inner side walls of the chamber, baffle, heat sink, or sensors for presence detection and local light measurement) are also applicable to the luminaire 400. Therefore, in the interests of brevity, those discussions are not repeated here.

Further discussions below are provided with respect to the luminaire 200 illustrated in FIG. 2. However, similar teachings are also applicable for the luminaires 300 and 400 illustrated in FIGS. 3 and 4, respectively.

The luminaire 200 illustrated in FIG. 2 includes outer side walls 205 close to the light sources. As described above, part of the beams that are generated close to the edge are reflected by the outer side walls 205. This may cause the total beam generated by the first light source or the total beam generated by the second light sources to become asymmetric. Therefore, in a preferred embodiment (not shown in FIG. 2), the chamber 200 would be rotationally symmetric with respect to one or more angles of rotation around an axis of symmetry of the chamber and the first and/or second light sources 202, 208 would be arranged within the chamber symmetrically with respect to the axis of symmetry of the chamber, in order to further preserve the total beam patterns within the chamber. Placing the same type of beam shaping optics at a symmetric position at the opposite edge of the substrate allows restoring the symmetry of the total beams. Preferably, the optical axes of the first and second light sources are parallel to the axis of symmetry of the chamber.

Besides preserving the beam shape, it may also be desirable to create an appealing luminance pattern when looking at the luminaire. Since the luminaire 200 contains two groups of sources with a different angular intensity distribution (i.e., the light sources 202 have angular intensity distribution that is different of that of the light sources 208), the brightness of the light sources 202 and 208 will depend on the angle at which the luminaire 200 is viewed. As a result, the luminance pattern from a large distance (i.e., high viewing angle) is determined by the position of the ambient beam light sources (i.e., the light sources 208), while the light from the task beam light sources (i.e., the light sources 202) is only visible from a close distance (i.e., looking up directly into the light sources 202). Therefore, the first and second light sources 202, 208 are preferably arranged within the chamber 200 so that they are well mixed by being evenly distributed and alternating. For example, the light sources 202 and 208 may be arranged in multiples of a 3×8 or 4×9 checkerboard pattern, so that the light of the two beams appears to be emitted from a single area source. In general, alternating patterns of light sources is preferred for creating the visual effect of a single light source because when the light sources 202 would be grouped together and separately from the group of the light sources 208, the luminaire 200 would look like a combination of separate light engines in one housing, which is unwanted.

Further, the light flux in both sub-beams should preferably be of similar magnitude. To achieve that, the number of the light sources 202 and the number of the light sources 208 are preferably balanced, e.g. 50-50%. The 60-40% or even 70-30% ratios could also be used, but strong deviations from the 50-50% distribution causes a large difference in drive current (more current is needed to obtain the same lumen output in a string with less light sources) and therefore a relatively high peak brightness for the light sources in the string with the smaller number of the light sources.

FIGS. 5A-11 illustrate some exemplary geometric combinations of the light sources 202 and 208 positioned within the chamber 204. Unlike FIGS. 2-4, which show a cross-sectional view of the chambers 204, 304, and 404, FIGS. 5A-11 show a top view of a chamber such as any one of the chambers 204, 304, and 404 (i.e., these figures illustrate how the light sources could be positioned on a substrate). In FIGS. 5A-11, each of the circles are intended to illustrate a position of a first light source configured to generate light beams with a first beam pattern (e.g. the light source 202), while each of the crosses are intended to illustrate a position of a second light source configure to generate light beams with a second beam pattern (e.g. the light source 208).

Figure 5A:
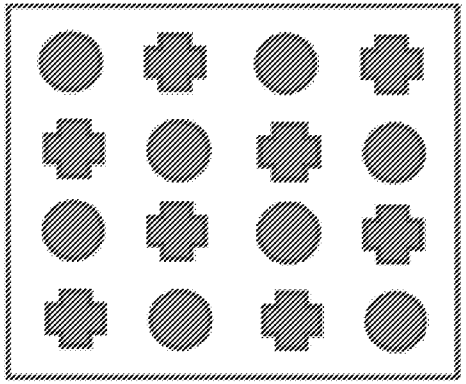
FIGS. 5A and 5B illustrate two checkerboard arrangements of the first and second light sources within a split beam luminaire according to two embodiments of the present invention.
Figure 5B:
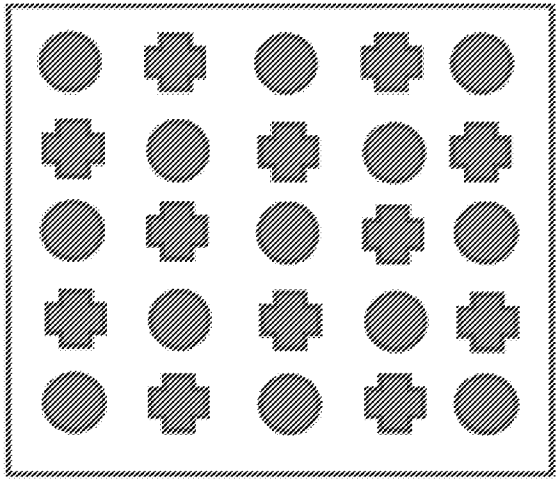

FIGS. 5A and 5B illustrate two checkerboard arrangements of the first and second light sources within a split beam luminaire according to two embodiments of the present invention. An arrangement shown in FIG. 5A has an even number of rows and an even number of columns, which is symmetric with respect to the outer side walls of the chamber and balanced (i.e., equal number of the first and second light sources). When both the number of rows and columns are odd, as shown in FIG. 5B, the geometry is symmetric as well. However, this geometry may be less preferred than that shown in FIG. 5A, due to the imbalance of the numbers of the first and second light sources.

Figure 5C:
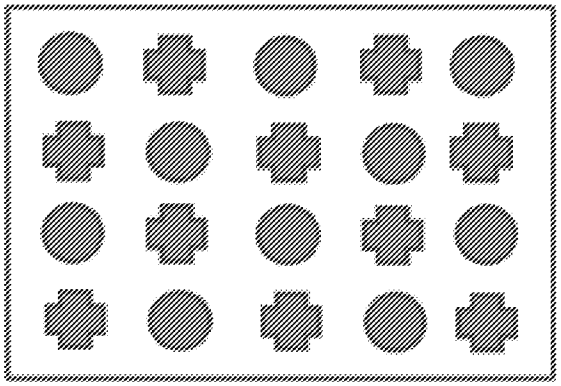
FIG. 5C illustrates a checkerboard arrangement of the first and second light sources within a split beam luminaire that would not be in accordance with the embodiments of the present invention.

Even-odd combinations, such as shown in FIG. 5C, are not symmetric and will cause asymmetry of the beam. Therefore, the checkerboard arrangement of the first and second light sources shown in FIG. 5C would not be in accordance with the embodiments of the present invention.

Figure 6A:
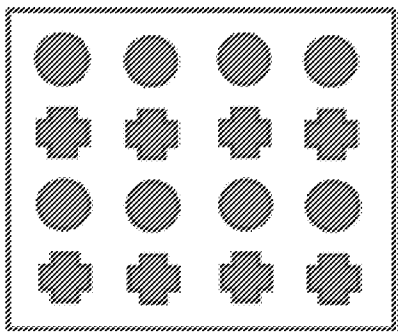
FIG. 6A illustrates a striped arrangement of the first and second light sources within a split beam luminaire that would not be in accordance with the embodiments of the present invention.
Figure 6B:
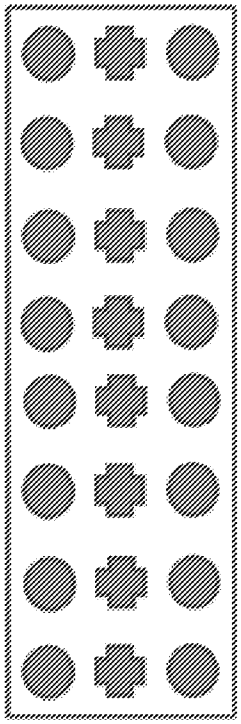
FIGS. 6B and 6C illustrate two striped arrangements of the first and second light sources within a split beam luminaire according to two embodiments of the present invention.
Figure 6C:
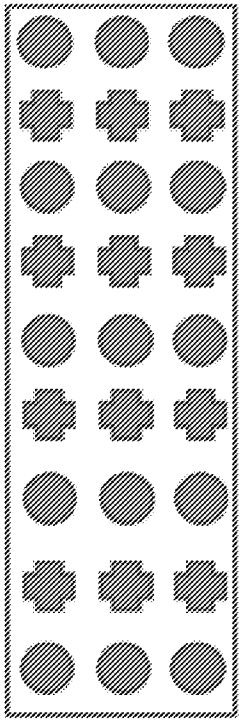

FIGS. 6A-6C show examples in which the light sources are placed in a geometry of alternating stripes or lines. The beam symmetry requires that the number of stripes is odd. Therefore, the arrangement of FIG. 6A would not be in accordance with the embodiments of the present invention, as the even number of stripes would cause beam asymmetry. In contrast, FIGS. 6B and 6C would be in accordance with the embodiments of the present invention because both of these arrangements include odd number of lines. Odd number of lines along the short side of the chamber, as shown in FIG. 6B with the stripes oriented along the long side, results in a symmetric but unbalanced arrangement (i.e., the number of the first light sources is not equal to the number of the second light sources). In order to have a balance between the number of the first light sources and the number of the second light source close to 50-50%, the stripes are preferably oriented along the short edge of a rectangular chamber, as shown in FIG. 6C (i.e., odd number of lines along the long side of the chamber).

Figure 7A:
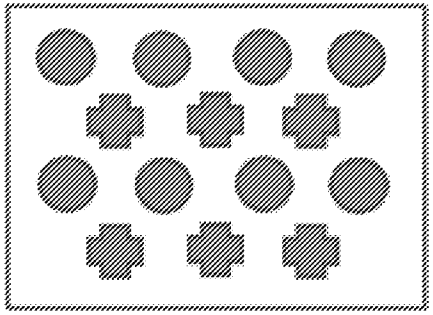
FIG. 7A illustrates a staggered arrangement of the first and second light sources within a split beam luminaire that would not be in accordance with the embodiments of the present invention.
Figure 7B:
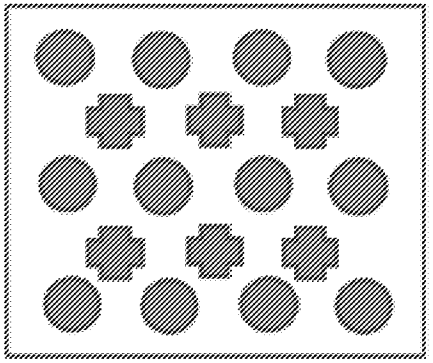
FIGS. 7B and 7C illustrate two staggered arrangements of the first and second light sources within a split beam luminaire according to two embodiments of the present invention.
Figure 7C:
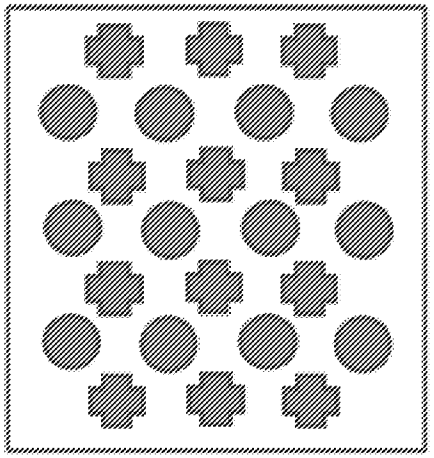

FIGS. 7A-7C illustrates various staggered rectangular grid arrangements of the first and second light sources within a split beam luminaire. As can be seen from FIGS. 7A-7C, staggered grid arrangements refer to the arrangements where the first light sources are arranged in a first rectangular grid and the second light sources are arranged in a second rectangular grid, offset from the first grid. In a staggered rectangular grid arrangement, the total number (i.e., for both the first and second light sources) of rows and the total number of columns should both be odd, in order to guarantee beam symmetry. FIG. 7A illustrates 4 rows and 7 columns. Since the number of rows is even, the resulting beam would be asymmetric. Therefore, arrangement of FIG. 7A would not be in accordance with embodiments of the present invention. In contrast, FIGS. 7B and 7C both illustrate exemplary arrangements with odd number of rows and odd number of columns. If the staggered grid arrangement contains a rectangular grid distribution of n×m light sources of the first type, the other type of light sources should be distributed in an $(n\pm1)\times(m\pm1)$ grid. A 50-50% balance is obtained when $m=n+1$ for the first rectangular grid, and the second grid is $(n+1)\times(m-1)$, as shown in FIG. 7C.

Figure 8B:
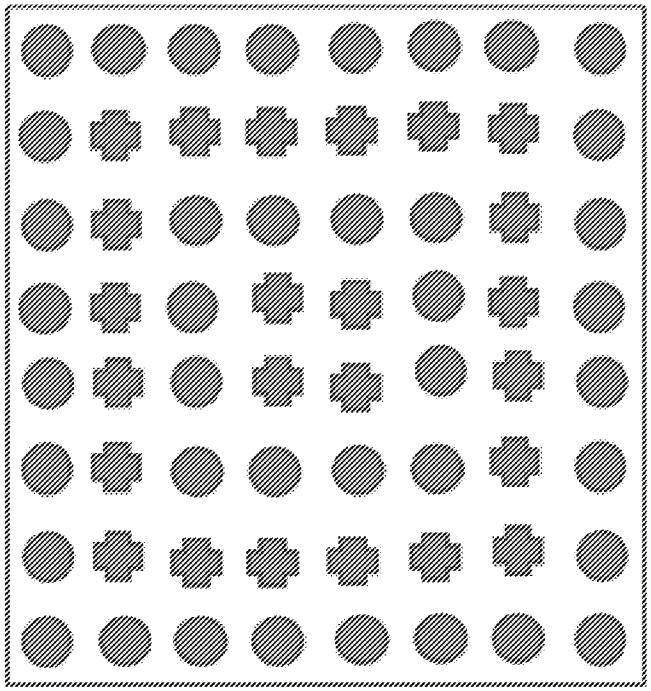
FIGS. 8A and 8B illustrate two concentric arrangements of the first and second light sources within a split beam luminaire according to two embodiments of the present invention.
Figure 8A:
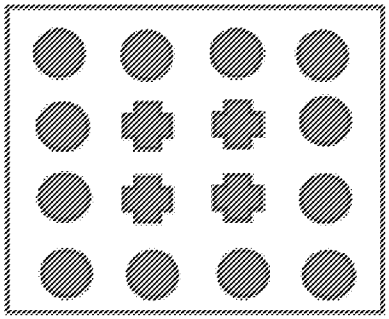

A next class of alternating and symmetric geometries consists of the concentric distributions, as shown in FIGS. 8A and 8B illustrating two concentric arrangements of the first and second light sources within a split beam luminaire according to two embodiments of the present invention. Note that tilings of the light sources of a particular type in the concentric geometries as shown are also symmetric, e.g. a square of 4 concentric tiles or a rectangle consisting of 4 concentric tiles in a row. In the concentric geometries, it may be advantageous to place the light sources producing the more narrow task beams closest to the outer side walls of the chamber, in particular in embodiments where the outer side walls are either far away (can then be placed closer to the sources) or transparent (will leave more distance to the wide beams, which are most important contributors to glare).

While the arrangements of FIGS. 8A and 8B are symmetric, they are not balanced. One way to improve the balance of the concentric arrangements could be to choose a different pitch for the different "rings" of light sources (not shown in the Figures). Another way to balance the geometry would be to break the alternating structures of FIGS. 8A and 8B and allow a doubling of concentric rings, as shown in FIGS. 9A and 9B.

Figure 9B:
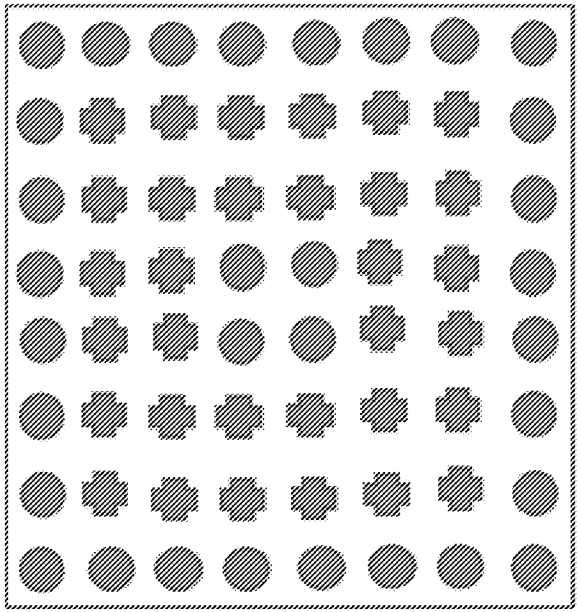
FIGS. 9A and 9B illustrate two further concentric arrangements of the first and second light sources within a split beam luminaire, according to two embodiments of the present invention.

FIG. 9B illustrates a concentric arrangement of 32 of the first light sources and 32 of the second light sources. The structure is both symmetric and balanced.

Figure 9A:
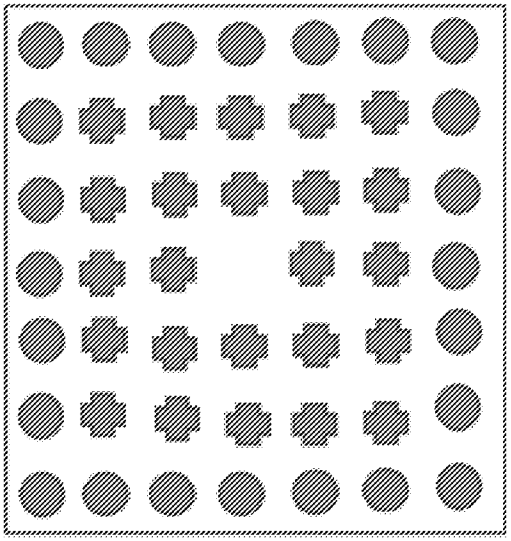

FIG. 9A illustrates a concentric arrangement of 24 of the first light sources and 24 of the second light sources. Note that the center position of the arrangement of FIG. 9A is left unoccupied in order to restore the balance of optical elements. Such geometry may be particularly of interest, because the empty space in the center may then be used for positioning a driver element, a sensor, or other electronics. In particular, since a sensor is a visible element, placing it at the center of the luminaire could improve the appearance of the luminaire and simplify the installation of the luminaire because there would be no preferred orientation for the installation.

Checkerboard arrangements such as shown in FIGS. 5A and 5B may also be configured such that an empty space is left in the center. An example is provided in FIG. 10. In an embodiment, the open space in the center may be delimited by inner side walls 1005 of the chamber. As described above, the inner side walls 1005 would be specular, substantially parallel to the optical axis of the light beams (within a few degrees deviation), and adapted to reflect at least a portion of light incident thereon to be incident onto the exit window of the chamber.

Figure 10:
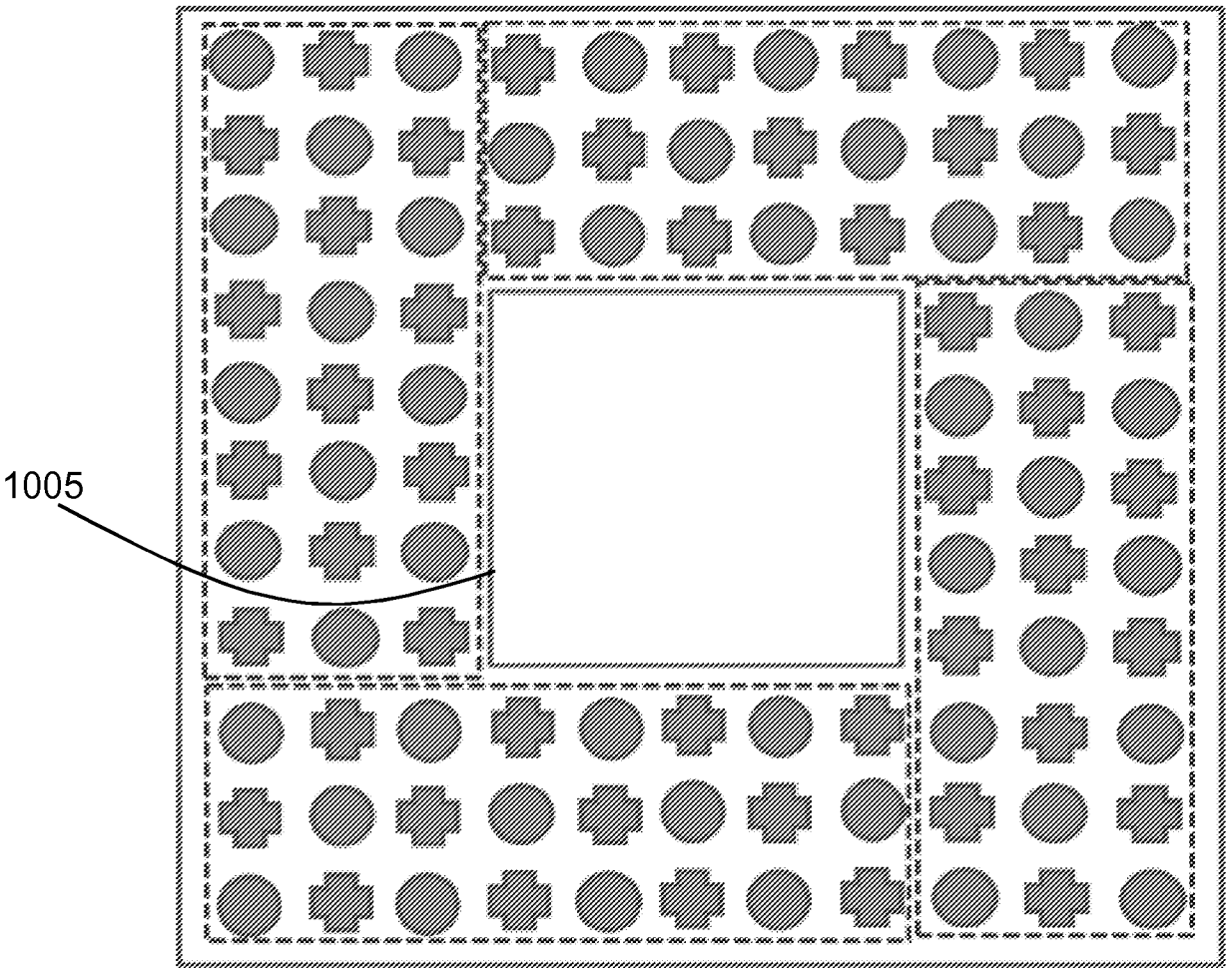
FIG. 10 illustrates an arrangement of the first and second light sources with a central open space, according to one embodiment of the present invention.

From a cost perspective, it may be advantageous to combine beam shaping optics of the light sources into larger clusters (e.g. a cluster of lenses), which can be produced as single optical components. The optimum cluster size could depend, among other things, on the manufacturing method, and be limited by shape and positioning tolerances. In FIG. 10, such clusters are indicated by dashed rectangles, in this case 3×8 clusters. This cluster arrangement is particularly advantageous, since it may also be used to form other arrangements, like the rectangular geometry depicted in FIG. 11. An elongated rectangular luminaire (like a conventional 30×120 cm luminaire) may use a light engine consisting of 4 clusters in a row (not shown in Figures).

Figure 11:
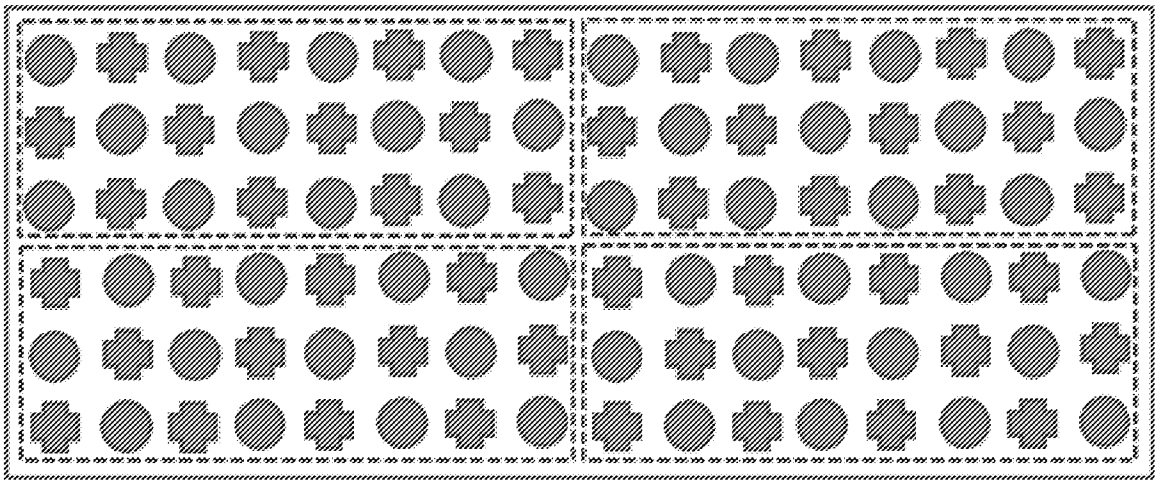
FIG. 11 illustrates an arrangement of the first and second light sources within a split beam luminaire formed of clusters, according to one embodiment of the present invention.

Besides the 3×8 clusters discussed above, any odd-even checkerboard cluster may be used to form both the geometry of FIG. 10 and a square or rectangular geometry as shown in FIG. 11. Further, the concentric geometries of FIGS. 9A and 9B may also be split up into four identical clusters (e.g. for cost reasons), though these clusters would then be less flexible to be used in other geometries.

In an embodiment, the PCB boards used as a substrate for the LEDs may be split up in a similar manner (e.g. four 3×8 LED boards) such that a board and optical array form a module. However, this is not necessarily always the case. Typically, strings of 11 or 12 LEDs in series are preferred because this number of LEDs on a string is sufficiently low to stay below a safe voltage and sufficiently high to keep the total current at a reasonable level. For this reason, the 3×8 and the 4×9 checkerboard clusters are particularly useful (in a ring or rectangular geometry of four clusters), as well as the 7×7 concentric configuration (FIG. 9A).

While FIGS. 5A-11 provide some examples of arrangements to illustrate which arrangements would and would not be in accordance with the embodiments of the present invention, a person skilled in the art could use these illustrations and the associated descriptions to come up with further geometric arrangements of the first and second light sources within a chamber which would also be in accordance with the embodiments of the present invention. Such further arrangements are, therefore, also within the scope of the present invention.

Figure 12:
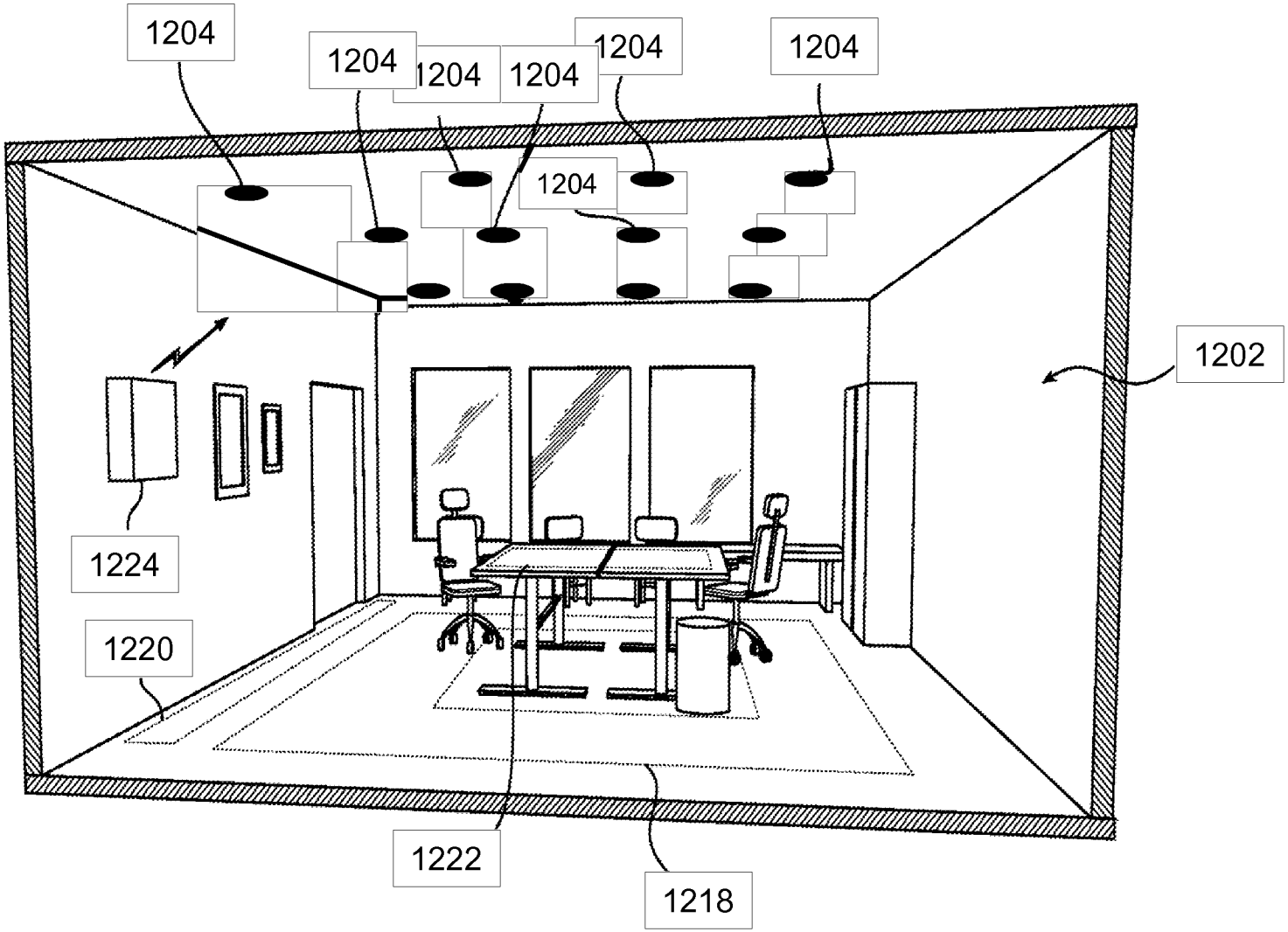
FIG. 12 illustrates an illumination system comprising a plurality of luminaires according to one embodiment of the present invention.

FIG. 12 illustrates a lighting system 1200 in an office space 1202 comprising a plurality of luminaires 1204 according to one embodiment of the present invention. The plurality of luminaires 1204 could comprise luminaires 200, 300, and/or 400 as described above, with the first and second light sources arranged within the chambers in any of the appropriate manners illustrated in FIGS. 5A-11. The first and second light sources of each of the luminaires 1204 may be configured to emit light beams with beam patterns required at each specific position within the office space 1202 (e.g. a general area 1218, a wall area 1220, or an office desk area 1222).

The lighting system 1200 may further include a control unit 1224 adapted to acquire a lighting level configuration for the office space 1202, e.g. the general areas 1218, the wall areas 1220 and the desk areas 1222, and to control the first and second light sources of each of the plurality of the luminaires 1204 such that a total illumination pattern produced by the plurality of luminaires 1204 corresponds to the lighting level configuration for the office space 1202. The lighting level configuration for the office space 1202 may be adjusted according to a fixed predetermined illumination pattern or may be dependent on e.g. an occupancy sensor included in one or more of the luminaires 1204. The lighting level configuration for the office space 1202 may include not only illumination levels for the different areas 1218, 1220, 1222, but may also relate to a specifically selected color temperature, e.g. within one or a plurality of areas 1218, 1220, 1222. Dynamic adjustment is thus possible and allows for improvements in relation to energy consumptions for the office space 1202. Further sensors may be provided, either integrated or separately, and possibly connectable to the one or more of the luminaires 1204. Such sensors may include e.g. day light detection and the control unit 1224 may be configured to also take such information into account when dynamically adjusting the illumination levels, locally and within the whole office space 1202.

The control unit 1224 may include a microprocessor, microcontroller, programmable digital signal processor or another programmable device. The control unit 1224 may also, or instead, include an application specific integrated circuit, a programmable gate array or programmable array logic, a programmable logic device, or a digital signal processor. Where the control unit 1224 includes a programmable device such as the microprocessor, microcontroller or programmable digital signal processor mentioned above, the processor may further include computer executable code that controls operation of the programmable device. Additionally, the control unit 1224 may be equipped with communication circuitry for allowing remote control of the lighting level configuration using e.g. a remote control.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. For example, the control unit may, as is shown in FIG. 12 be a central unit, but the luminaires may also be locally controlled by a sensing/control unit that may be part of the luminaire. Also a combination of central control for the some luminaires and local control for the other luminaires may also be possible and is within the scope of the invention. Further, in the claims, the word "comprising" does not exclude other elements or steps, and the indefinite article "a" or "an" does not exclude a plurality.

The invention claimed is:

1. A luminaire comprising:

a plurality of first light sources, wherein each of the first light sources includes a first light emitter and an associated first beam optics, and each of the first light sources configured to emit, using the first beam optics, a first light beam of a first beam pattern having a first angular intensity distribution;

a plurality of second light sources, wherein each of the second light sources includes a second light emitter and an associated second beam optics, and each of the second light sources configured to emit, using the second beam optics, a second light beam of a second beam pattern having a second angular intensity distribution, wherein each of the first and second pluralities of light sources are independently controllable, and an optical axis of the each first light beam is parallel to an optical axis of the each second light beam; and a chamber encompassing the first light sources and the second light sources, the chamber comprising one or more outer side walls and an exit window, wherein the one or more outer side walls comprise sections which are specularly reflective and section which are partially specularly transmitting, and are adapted to reflect at least a portion of light incident thereon to be incident onto the exit window, and are substantially parallel to the optical axis of each first light beam and the optical axis of each second light beam.

2. The luminaire according to claim 1, wherein the exit window is configured to provide controlled beam broadening of at least a portion of the first and second light beams incident thereon.

3. The luminaire according to claim 2, wherein the exit window comprises a holographic diffuser with Gaussian scattering profile with the full width half maximum value between 10 and 20 degrees or a lens array with an f# between 2 and 5.

4. The luminaire according to claim 1, wherein the one or more outer side walls are faceted and/or curved.

5. The luminaire according to claim 1, wherein the chamber further comprises one or more inner side walls, wherein the one or more inner side walls are substantially specular, adapted to reflect at least a portion of light incident thereon to be incident onto the exit window, and are substantially parallel to the optical axis of the each first light beam and the optical axis of the each second light beam.

6. The luminaire according to claim 1, wherein the chamber is rotationally symmetric with respect to one or more angles of rotation around an axis of symmetry of the chamber, and wherein the first light sources and/or the second light sources are arranged within the chamber symmetrically with respect to the axis of symmetry of the chamber.

7. The luminaire according to claim 1, wherein the first light sources and the second light sources are arranged within the chamber so that the first light sources and the second light sources are evenly distributed and alternating.

8. The luminaire according to claim 7, wherein the first light sources and the second light sources are arranged within the chamber in at least a first cluster and a second cluster, each of the first cluster and the second cluster having the first light sources and the second light sources arranged in either a 3×8 checkerboard pattern or a 4×9 checkerboard pattern.

9. The luminaire according to claim 1, wherein the wide beam optics pattern is hollow shaped and illuminates a region substantially between 2×20 degrees and 2×60 degrees.

10. The luminaire according to claim 1, wherein the narrow beam optics pattern is narrow shaped and illuminates a region substantially between 2×25 degrees and 2×35 degrees.

11. The luminaire according to claim 1, wherein the distribution of the first and second light sources in the chamber are arranged to reduce a difference in drive currents by balancing the number of first and second light sources in a ratio between 3/7 and 7/3.

12. The luminaire according to claim 1, wherein the distribution of the first and second light sources in the chamber are arranged to reduce a difference in drive currents by balancing the number of first and second light sources in a ratio between 4/6 and 6/4.

13. The luminaire according to claim 1, wherein the distribution of the first and second light sources in the chamber are arranged to reduce a difference in drive currents by balancing the number of first and second light sources in a ratio equal to 1.

14. The luminaire according to claim 1, wherein the first and second beam optics are selected such that a brightness of the first and second pluralities of light sources depend on an angle at which the luminaire is viewed.

15. The luminaire according to claim 1, wherein each of the one or more walls is at a distance of a half pitch from the nearest light source of the first light sources or the second light sources.

16. The luminaire according to claim 1, further comprising a least one of:

one or more sensors for presence detection, and a sensor for local light measurement.

17. The luminaire according to claim 16, wherein the one or more sensors for presence detection comprises a first sensor and a second sensor, the first sensor having a detection cone substantially overlapping with the first light beam, the second sensor being a broad-angle sensor.

18. A luminaire comprising:

a plurality of first light sources, each of the first light sources configured to emit, using the first beam optics, a first light beam of a first beam pattern having a first angular intensity distribution, a plurality of second light sources, each of the second light sources configured to emit, using the second beam optics, a second light beam of a second beam pattern and an optical axis of the each first light beam is parallel to an optical axis of the each second light beam having a first angular intensity distribution, wherein each of the first and second pluralities of light sources are independently controllable, and a chamber encompassing the first light sources and the second light sources, the chamber comprising one or more outer side walls and an exit window, wherein the one or more outer side walls are substantially specular, wherein said one or more outer side walls are both partially specularly reflective and partially specularly transmitting, and partially reflect at least a first portion of light incident thereon to be incident onto the exit the optical axis of the each second light beam and partially transmit a second portion of the light incident thereon;

wherein each of the first light sources comprises a first light emitter and an associated narrow beam optics, and each of the second light sources comprises a second light emitter and an associated wide beam optics.

* * * * *